US009509083B2

(12) United States Patent
Yang

(10) Patent No.: US 9,509,083 B2
(45) Date of Patent: Nov. 29, 2016

(54) WATERPROOF SOCKET HAVING A WATERPROOFING INNER CORE MOVABLE BETWEEN USAGE AND NON-USAGE POSITIONS

(71) Applicant: Jiaming Yang, Ningbo (CN)

(72) Inventor: Jiaming Yang, Ningbo (CN)

(73) Assignees: Jiaming Yang, Ningbo, Zhejiang (CN); Yang Yang, Chicago, IL (US)

( * ) Notice: Subject to any disclaimer, the term of this patent is extended or adjusted under 35 U.S.C. 154(b) by 0 days.

(21) Appl. No.: 14/899,562

(22) PCT Filed: Dec. 25, 2013

(86) PCT No.: PCT/CN2013/090458

§ 371 (c)(1),
(2) Date: Dec. 18, 2015

(87) PCT Pub. No.: WO2015/085632

PCT Pub. Date: Jun. 18, 2015

(65) Prior Publication Data

US 2016/0156123 A1 Jun. 2, 2016

(30) Foreign Application Priority Data

Dec. 11, 2013 (CN) ..... 2013 1 0666342

(51) Int. Cl.

| | |
|---|---|
| ***H01R 13/52*** | (2006.01) |
| ***H01R 24/78*** | (2011.01) |
| ***H01R 25/00*** | (2006.01) |
| ***H01R 13/453*** | (2006.01) |

(52) U.S. Cl.

CPC ..... *H01R 13/5202* (2013.01); *H01R 13/453* (2013.01); *H01R 13/521* (2013.01); *H01R 13/5219* (2013.01); *H01R 24/78* (2013.01); *H01R 25/006* (2013.01)

(58) Field of Classification Search

CPC H01R 13/44; H01R 13/443; H01R 13/4532; H01R 13/4536; H01R 13/4538; H01R 13/52; H01R 13/521; H01R 13/5213; H01R 13/453

USPC ..... 439/271–275, 278, 587

See application file for complete search history.

(56) References Cited

U.S. PATENT DOCUMENTS 5,645,442 A * 7/1997 Cairns ..... H01R 13/523 439/201

5,685,727 A * 11/1997 Cairns ..... G02B 6/3816 385/56

(Continued)

*Primary Examiner* — Chandrika Prasad

(74) *Attorney, Agent, or Firm* — Raymond Y. Chan; David and Raymond Patent Firm

(57) ABSTRACT

A waterproof socket includes an inner core fixing base disposed between a retention frame and a socket base. Lower insertion holes are coaxial with an output terminal and are formed in the inner core fixing base. An accommodating groove is formed between two lower insertion holes. A waterproof inner core is disposed in the accommodating groove. The waterproof inner core includes a main body movably inserted in the accommodating groove. Two upper seal doors are sealed at upper insertion holes of the retention frame and are disposed on two upper sides of the main body, and two swing rods are symmetrically disposed below the upper seal doors. One end of each of the swing rod is hinged to the main body, and the other end of the swing rod is provided with a lower seal door for sealing the lower insertion holes of the inner core fixing base.

20 Claims, 9 Drawing Sheets

(56) References Cited

U.S. PATENT DOCUMENTS 5,707,251 A * 1/1998 Sakai ..... H01R 13/5208 439/274
5,842,878 A * 12/1998 Huag ..... H01R 13/6275 439/139
9,325,363 B2 * 4/2016 Ferraro ..... H01R 13/5213
2007/0224881 A1 * 9/2007 Fujiwara ..... H01R 13/5221 439/587
2011/0086544 A1 * 4/2011 Yoshioka ..... H01R 13/4362 439/587
2013/0052864 A1 * 2/2013 Kataoka ..... H01R 13/5208 439/587
2013/0330951 A1 * 12/2013 Yudate ..... H01R 13/5202 439/271
2016/0064851 A1 * 3/2016 Kataoka ..... H01R 13/5202 439/587

* cited by examiner

WATERPROOF SOCKET HAVING A WATERPROOFING INNER CORE MOVABLE BETWEEN USAGE AND NON-USAGE POSITIONS

CROSS REFERENCE OF RELATED APPLICATION

This is a non-provisional application that claims priority to international application number PCT/CN2013/090458, international filing date Dec. 25, 2013, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to an electrical wall socket, and in particular to a waterproof socket to prevent water or moisture entering into the electrical components of the waterproof socket for maximizing the safety of the wall socket.

2. Description of Related Arts

A wall socket is usually mounted on a wall, a floor or a wiring board, wherein most existing sockets in the market do not have any waterproof feature. When there is water entering into the socket, short circuit occurs easily. It will cause serious accidents especially in some areas having a higher chance of water or moisture built up, such as a bathroom, a kitchen or the like. For this reason, a waterproof socket is developed. Accordingly, the waterproof socket generally comprises a waterproof cover mounted at the socket. In this case, the socket is covered tightly by the waterproof cover when the socket is not used, and the waterproof cover is opened when the socket is needed to be used for plugging a plug of an electrical appliance thereto. For this open/close structure, when the waterproof cover is forgotten to cover the socket, it does not have a waterproof effect, and also it does not have the waterproof effect when the plug is connected with the socket. Chinese Application, CN101383465A, titled "a waterproof socket" published on Mar. 11, 2009, disclosed a waterproof socket including a main body of socket. At least one pair of pin holes is formed at bottom of an inner cavity of the main body of the socket. Accommodating cavities corresponding to the pin holes are formed in lower part of the main body of the socket. Insertion and sleeve pieces are formed in each accommodating cavity, and each insertion and sleeve piece is constituted of a wiring terminal and an insertion and sleeve reed. Each insertion and sleeve reed is positioned under the corresponding pin hole. A waterproof cover is incorporated with a waterproof ring formed at edges of the inner cavity of the main body of socket and is hinged in the main body of socket, wherein the waterproof ring is formed together with the main body of socket by injection molding to form an integrated structure. This structure also form the waterproof cover above the socket only. However, it cannot prevent the water from entering from a side or bottom of the socket. In other words, the socket does not have the waterproof effect to prevent water or moisture entering into the socket at any side.

SUMMARY OF THE PRESENT INVENTION

The invention is advantageous in that it provides a waterproof socket to prevent water or moisture entering into the electrical components of the waterproof socket for maximizing the safety of the wall socket.

Additional advantages and features of the invention will become apparent from the description which follows, and may be realized by means of the instrumentalities and combinations particular point out in the appended claims.

According to the present invention, the foregoing and other objects and advantages are attained by a waterproof socket comprising a socket panel, a retention frame and a socket base. A conducting sheet having output terminals and wiring terminals, are embedded in the socket base. Upper insertion holes are coaxial with the output terminals and are formed in the socket panel and the retention frame. A wire assembly is sleeved with the wiring terminals of the conducting sheet and is mounted at bottom of the socket base. An inner core fixing base is provided between the retention frame and the socket base. Lower insertion holes are coaxial with the output terminals and are formed in the inner core fixing base. An accommodating groove is provided between two lower insertion holes. A waterproof inner core is provided in the accommodating groove. The waterproof inner core comprises a main body movably inserted in the accommodating groove. Two upper seal doors are capable of sealing the upper insertion holes in the retention frame and are formed on two sides above the main body. Two swing rods are symmetrically provided below the upper seal doors. One end of each of the swing rods is hinged to the main body, and the other end of each of the swing rods is provided with a lower seal door for sealing at one of the lower insertion holes in the inner core fixing base. A rotation and guide apparatus of the main body is provided between the inner core fixing base and the waterproof inner core. A torsion spring is arranged for driving the main body to rotate and restore position and is provided between a bottom part of the main body and the accommodating groove of the inner core fixing base. A restoring and down-pressing device is provided between the retention frame and the swing rods. When the socket is used, pins of a plug will drive the upper seal doors to move downwards to move apart from the upper insertion holes, and the rotation and guide apparatus leads the main body to rotate, so as to bring the swing rods to separate from a restoring and down-pressing position and rotate upwards, and the lower seal doors move apart from the lower insertion holes, and the torsion spring is stretched to be stressed. When the socket is not used, due to a restoring force of the torsion spring and the rotation and guide apparatus, the main body rotates to move upwards to its restore position, so as to bring the upper seal doors to seal at the upper insertion holes, and at the same time, the swing rods enter into the restoring and down-pressing device. Since the restoring and down-pressing device prevents the swing rods from rotating downwards, the lower seal doors are made to seal the lower insertion holes.

The rotation and guide apparatus comprises an arc protrusion provided on the inner core fixing base and a sliding bar provided on a sidewall of the main body of the waterproof inner core. The sliding bar is guided by an upper surface of the arc protrusion.

The restoring and down-pressing device comprises two blockers provided at bottom of the retention frame. The center of an upper end of the main body having a through hole. The blockers are against the upper surfaces of corresponding swing rods after passing through the through hole downwards. A sliding groove is formed on the upper surface of the swing rod, and the blockers move out of the sliding grooves when the main body of the waterproof inner core moves downwards and rotates, and the blockers are embedded into the sliding grooves when the main body of the waterproof inner core restores position.

A spring having a W-shape is provided between the two swing rods, and two ends of the spring are inserted into the sidewalls of the corresponding swing rod respectively.

The spring is connected on the main body through a closing plate.

Sealing sheets are embedded in an upper surface of the retention frame and a lower surface of the inner core fixing base, wherein each sealing sheet has one or more small sealing holes are coaxial with the upper insertion holes and the lower insertion holes. A diameter of each of the sealing hole is smaller than a diameter of each of the upper insertion holes and a diameter of each of the lower insertion hole.

Each of the wiring terminals of the conducting sheet is divided into two sections in axial direction, and an inner diameter of a lower section is larger than an inner diameter of an upper section.

A connecting sheet is affixed at a side of the conducting sheet, and each of the wiring terminals is disconnected along the axial direction. A first half of each of the wiring terminals is connected with the conducting sheet, and a second half of each of the wiring terminals is connected with the connecting sheet.

A waterproof sealing ring is inserted and mounted in the wire assembly, and a screw cover is rotatably mounted at bottom of the wire assembly, wherein an inner cavity of the screw cover has a conical shape. The screw cover rotates upwards to make a lower end of the wire assembly and the waterproof sealing ring to press tightly to center.

The wire assembly and the socket base are threaded and connected, and a sealing washer is provided at a joint between the wire assembly and the socket base.

The waterproof socket of the present invention is able to be mounted on a wall, a floor or an extension cord structure. When the plug is not inserted, the upper seal doors are sealed at the upper insertion holes of the retention frame, and the lower seal doors are sealed at the lower insertion holes of the inner core fixing base, such that the dual protection configuration prevents water or moisture from entering into the waterproof socket. When the plug is connected with the socket, the plug cooperates with two layers of upper sealing sheet and lower sealing sheet, which can prevent water from entering into the waterproof socket efficiently. An upward rotation of the screw cover can ensure the lower end of the wire assembly and the waterproof sealing ring to press electric wire tightly so as to prevent water from entering into the bottom portion. Even if the socket is entirely submerged into water, there will prevent water entering into the socket, which is very safe. Various kinds of wires of different thickness are able to be inserted through the wiring terminals on the conducting sheet, which has a broader range of usage. The socket has advantages of a simple structure and a good waterproof effect, which has a good market prospect.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
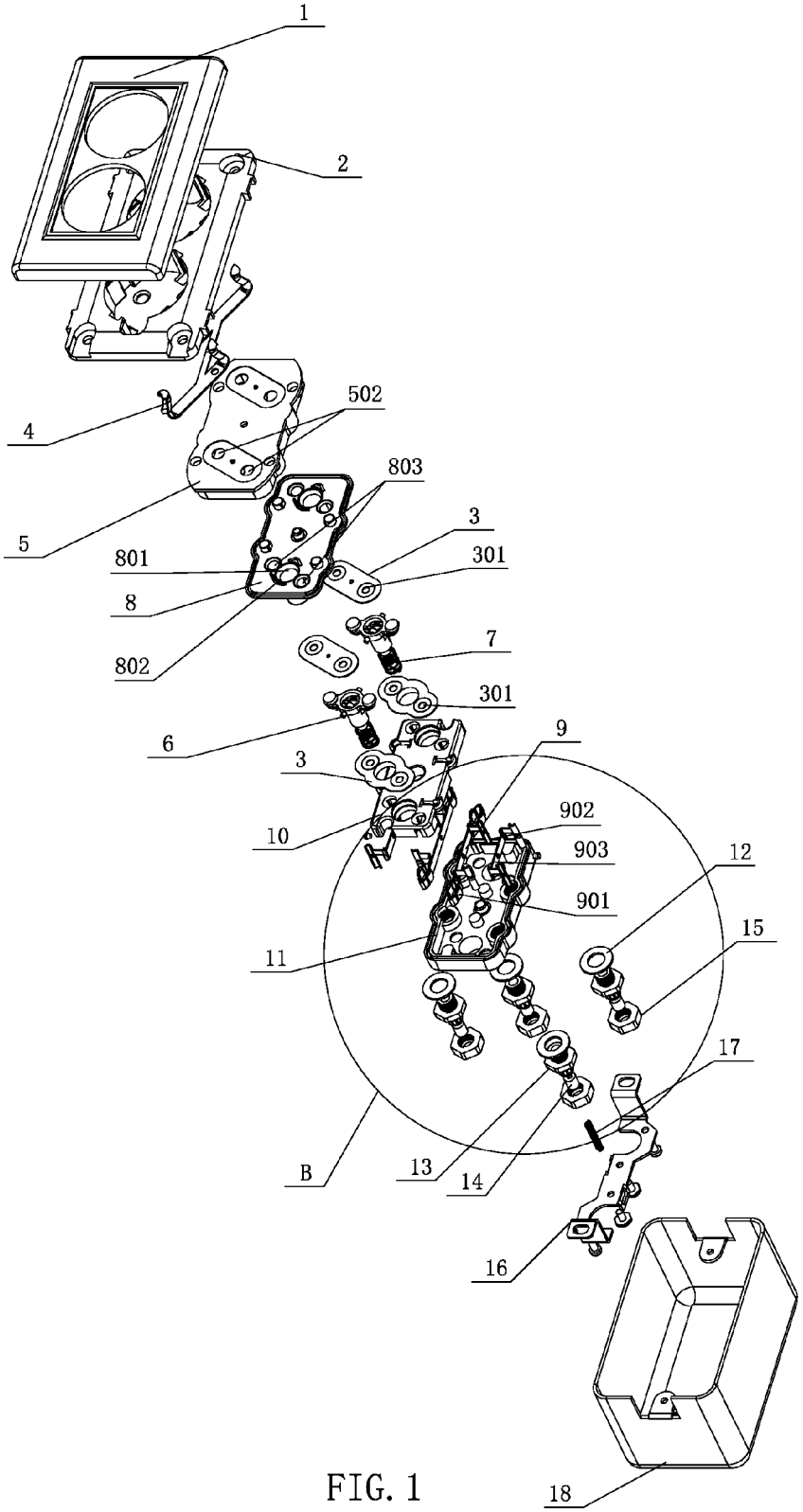
FIG. 1 is an exploded perspective view of a waterproof socket according to a preferred embodiment of the present invention.
Figure 2:
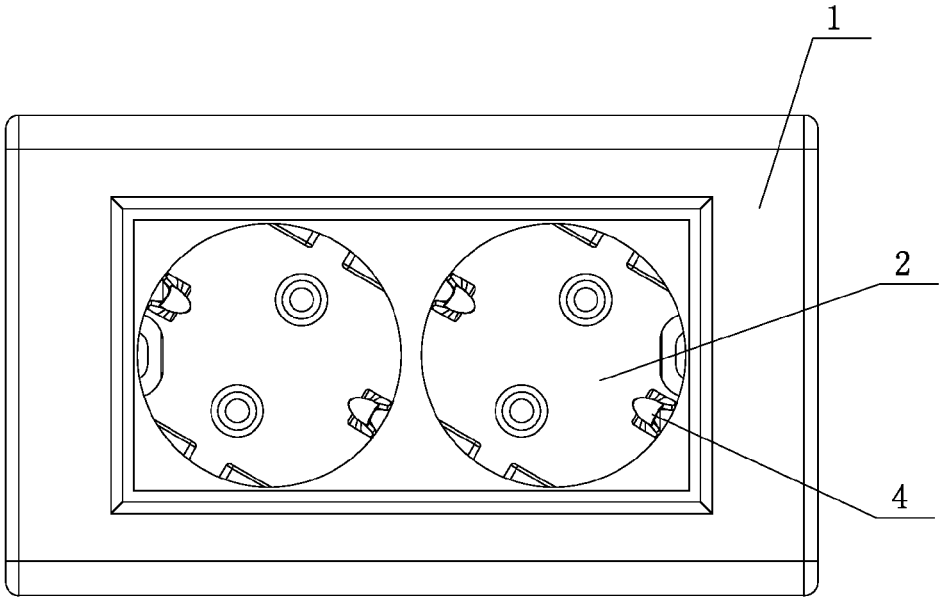
FIG. 2 is a schematic diagram of the waterproof socket according to the above preferred embodiment of the present invention.
Figure 3:
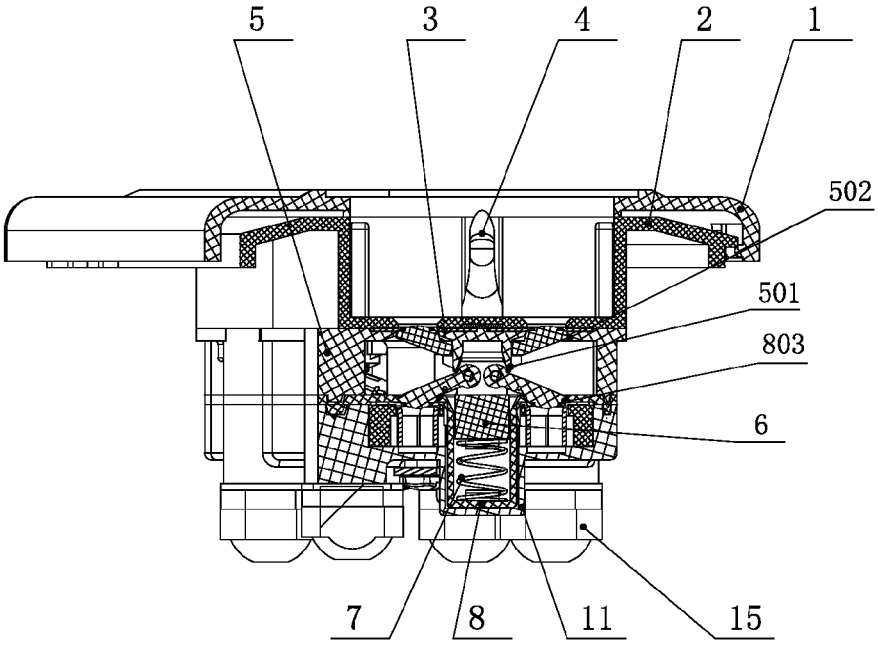
FIG. 3 is a sectional view of the waterproof socket according to the above preferred embodiment of the present invention.
Figure 4:
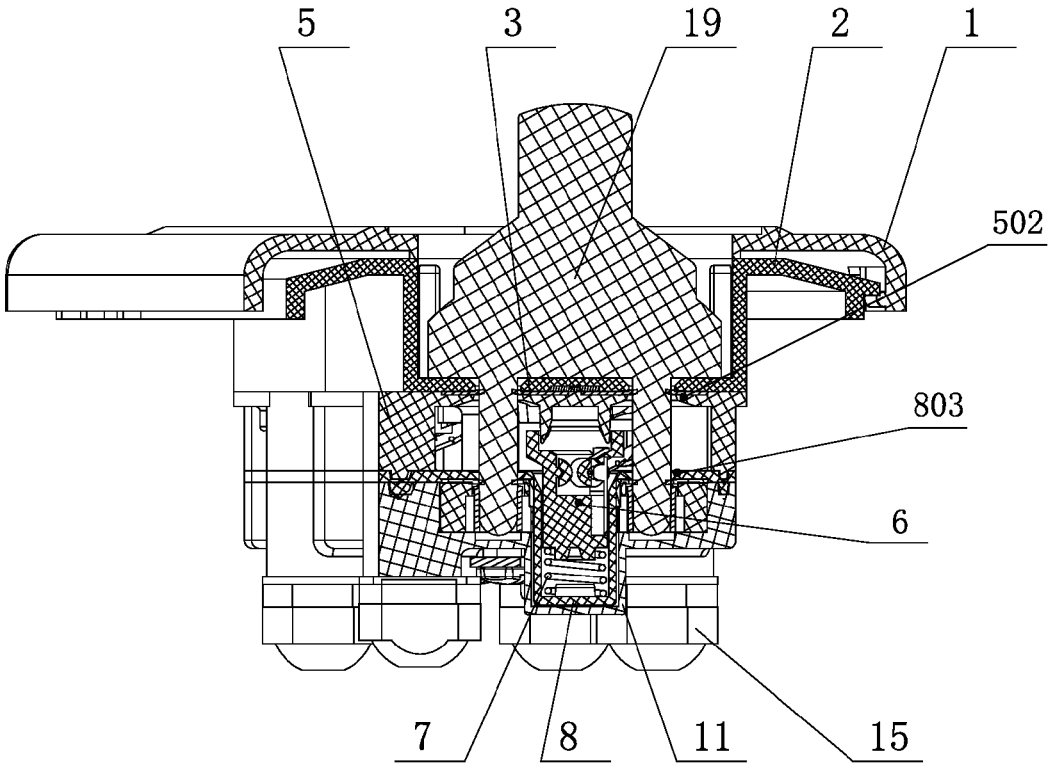
FIG. 4 is a sectional view of the waterproof socket according to the above preferred embodiment of the present invention, illustrating a plug inserted into the waterproof socket.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

As shown in FIGS. 1 to 4, a waterproof socket according to a preferred embodiment of the present invention is illustrated, wherein the waterproof socket comprises a socket panel 2, an outer casing 18 coupled to the socket panel 2, a retention frame 5 and a socket base 11, wherein the retention frame 5 and the socket base 11 are provided between the socket panel 2 and the outer casing 18. The waterproof socket further comprises a face cover 1 coupled in front of the socket panel 2 for enhancing the aesthetic appearance of the present invention. A conducting sheet 9, having one or more output terminals 901 and a wiring terminal 902, is embedded in the socket base 11. A plurality of upper insertion holes 502 are formed in the socket panel 2 and the retention frame 5 to coaxially align with the output terminals 901. When a plug 19 is inserted into the upper insertion holes 502, it is electrically connected with the output terminals 901 of the conducting sheet 9. A wire assembly 13, which sleeves with the wiring terminals 902 of the conducting sheet 9, is provided at bottom of the socket base 11, wherein a conducting wire is connected with the wiring terminals 902 of the conducting sheet 9 after passing through the wire assembly 13. An inner core fixing base 8 is provided between the retention frame 5 and the socket base 11. The inner core fixing base 8 has a plurality of lower insertion holes 803 coaxially aligned with the output terminals 901 so as to coaxially align with the upper insertion holes 502. An accommodating groove 801 is indented on the inner core fixing base 8 and is formed between two lower insertion holes 803 of the inner core fixing base 8. A waterproof inner core 6 is provided in the accommodating groove 801 of the inner core fixing base 8. A conducting sheet fixing cover 10 is provided on the socket base 11, wherein the conducting sheet fixing cover 10 encloses a peripheral side of the conducting sheet 9. The conducting sheet fixing cover 10 is located below the inner core fixing base 8 to prevent the conducting sheet 9 from being moved, and is able to isolate the conducting sheet 9 to prevent a leakage of electricity. Sealing sheets 3 are embedded on an upper surface of the retention frame 5 and a lower surface of the inner core fixing base 8. Each of the sealing sheets 3 has one or more small sealing holes 301 coaxial with the upper insertion holes 502 and the lower insertion holes 803. A diameter of each of the sealing holes 301 is smaller than a diameter of each of the upper insertion holes 502 and a diameter of each of the lower insertion holes 803. When pins of the plug 19 are inserted into the upper insertion holes 502 and the lower insertion holes 803, the pins pass through the sealing holes 301 to prevent water entering into the conducting sheet 9. A ground clamp 4 is provided in the socket panel 2, and a ground connecting sheet 16 is fixed at outside of the socket base 11, and a ground spring 17 is provided between the ground clamp 4 and the ground connecting sheet 16.

Figure 5:
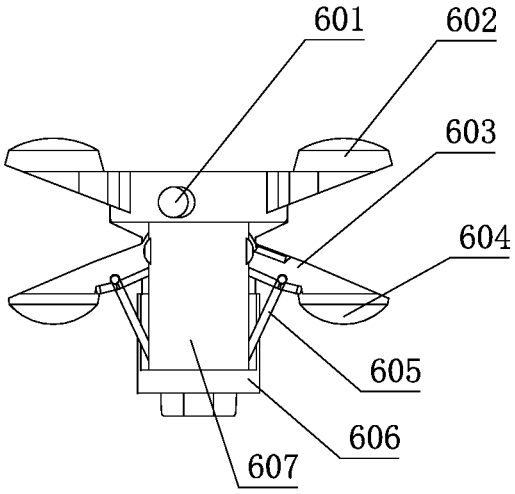
FIG. 5 is a schematic view of a waterproof inner core of the waterproof socket according to the above preferred embodiment of the present invention.
Figure 6:
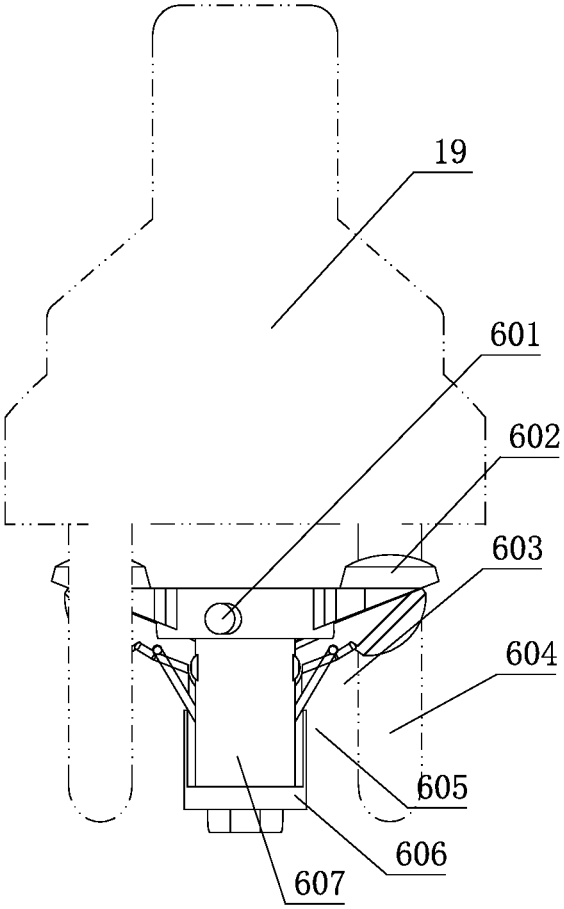
FIG. 6 is a schematic diagram of the waterproof inner core of the waterproof socket according to the above preferred embodiment of the present invention, illustrating the plug inserted into the waterproof socket.
Figure 7:
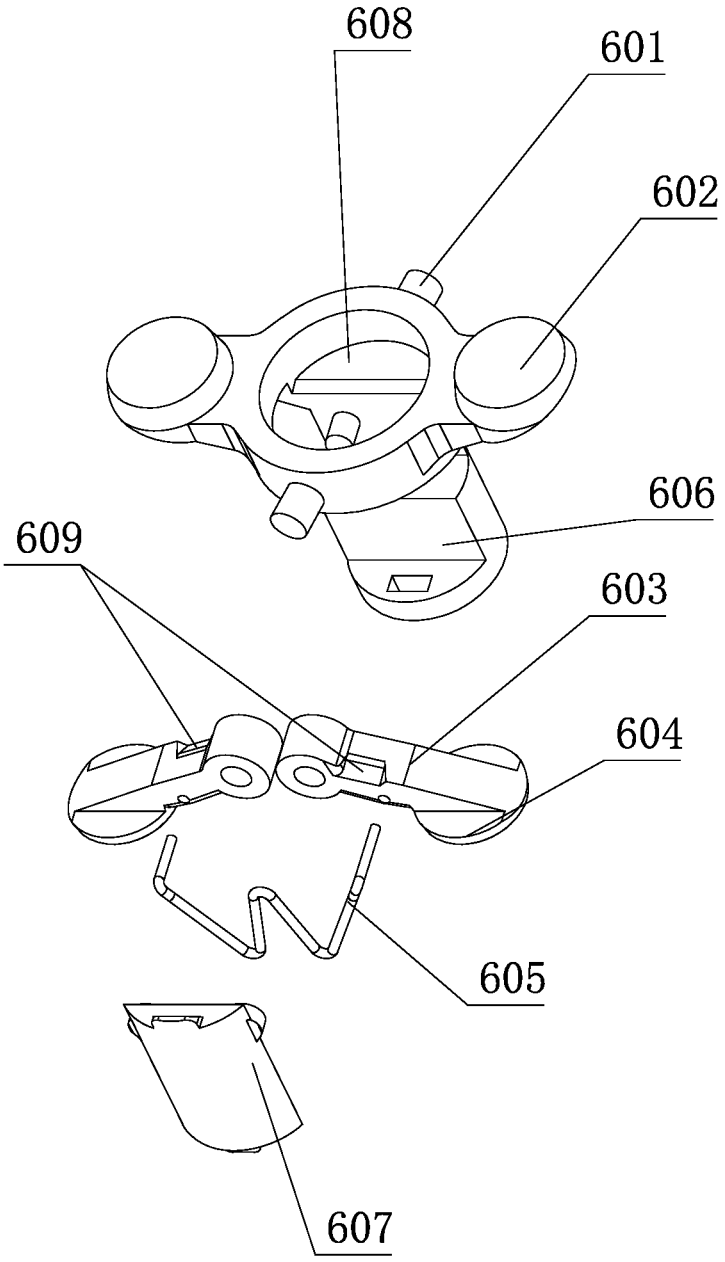
FIG. 7 is an exploded perspective view of the waterproof inner core of the waterproof socket according to the above preferred embodiment of the present invention.

As shown in FIGS. 5 to 7, the waterproof inner core 6 comprises a main body 606 movably inserted into the accommodating groove 801, and two upper seal doors 602 provided on two upper peripheral sides of the main body 606 for sealing the upper insertion holes 502 of the retention frame 5. The upper seal door 602 will move depart from the upper insertion holes 502 of the retention frame 5 when the main body 606 moves downwards. Two swing rods 603 are symmetrically provided below the upper seal doors 602. An inner end of each of the swing rods 603 is pivotally hinged to the main body 606 and an opposed outer end of each of the swing rods 603 is extended toward the lower insertion holes 803, wherein a lower seal door 604 is provided at the outer end of each of the swing rods 603 to seal with the lower insertion hole 803 at the inner core fixing base 8. The swing rods 603 are against a peripheral edge of the accommodating groove 801 at the inner core fixing base 8 to produce a rotation that drives the lower seal doors 604 to rotate upwards to leave the lower insertion holes 803 of the inner core fixing base 8 when the main body 606 moves downwards. A rotation and guide apparatus is provided between the inner core fixing base 8 and the waterproof inner core 6, and the rotation and guide apparatus would drive the main body 606 to rotate when the main body 606 of the waterproof inner core 6 moves downwards. The rotation and guide apparatus can be implemented by many ways, for example, a slope, an inclined groove or the like. The rotation and guide apparatus of the present invention comprises an arc protrusion 802 formed on the inner core fixing base 8 and a sliding bar 601 provided on a side wall of the main body 606 of the waterproof inner core 6. The sliding bar 601 is guided by an upper surface of the arc protrusion 802. Therefore, the sliding bar 601 is blocked and guided to move sidewardly by the arc protrusion 802 to drive the main body 606 to rotate when the main body 606 moves downwards. A torsion spring 7 is provided between a bottom portion of the main body 606 and the accommodating groove 801 of the inner core fixing base 8. A restoring force of the torsion spring 7 would make the main body 606 of the waterproof inner core 6 to rotate and restore to its original position when there is no other external force, and the rotation and guide apparatus ensures the main body 606 to move upwards at the time of rotating and restoring position. In particular, the sliding bar 601 is guided to top of the arc protrusion 802 by the block of the protrusion of arc shape 802, so as to bring the main body 606 to move upwards.

A restoring and down-pressing device is provided between the retention frame 5 and the swing rods 603. The swing rods 603 move away from the restoring and down-pressing device when the main body 606 moves downwardly and rotatably. The swing rods 603 are driven by the restoring and down-pressing device when the main body 606 rotates and moves upwards to restore position. Since the restoring and down-pressing device prevents the swing rods 603 from rotating downwards, it make the lower seal doors 604 to seal at the lower insertion holes 803. Therefore, the restoring and down-pressing device only needs to press against the swing rods 603 when the main body 606 of the waterproof inner core 6 rotates and moves upward to restore position, and can be implemented in many ways. The restoring and down-pressing device of the present invention comprises two blockers 501 formed at a bottom of the retention frame 5. The center of an upper end of the main body 606 has a through hole 608. The blockers 501 are against the upper surfaces of corresponding swing rods 603 after passing through the through hole 608 downwards. Sliding grooves 609 are formed in the upper surfaces of the swing rods 603. When the main body 606 of the waterproof inner core 6 moves downwards and rotates, the blockers 501 move out of the sliding grooves 609, such that the swing rods 603 will not be blocked by the blockers 501 from rotating upwards. The blockers 501 are embedded into the sliding grooves 609 to press against the upper surfaces of the swing rods 603, so as to make the lower seal doors 604 of the swing rods 603 to rotate downwards for sealing at the lower insertion holes 803 of the inner core fixing base 8 again when the main body 606 of the waterproof inner core 6 is moved at the restore position. In order to facilitate embedding and sliding of the blockers 501, each of bottom parts of the sliding grooves 609 slopes downwards from inside to outside. A spring 605 having a W-shape is provided between the two swing rods 603, and two ends of the spring 605 are inserted into sidewalls of corresponding swing rods 603 respectively, wherein a restoring force of the spring 605 will make the lower seal doors 604 of the swing rod 603 to keep upturned or keep under-pressed. The spring 605 is coupled to the main body 606 through a closing plate 607, which prevents the swing rods 603 and the spring 605 from dropping out.

The socket panel 2, the retention frame 5, the inner core fixing base 8, the conducting sheet fixing cover 10 and the socket base 11 are seamlessly welded by using ultrasonic at the assembling time to prevent joint places from leaking.

Figure 8:
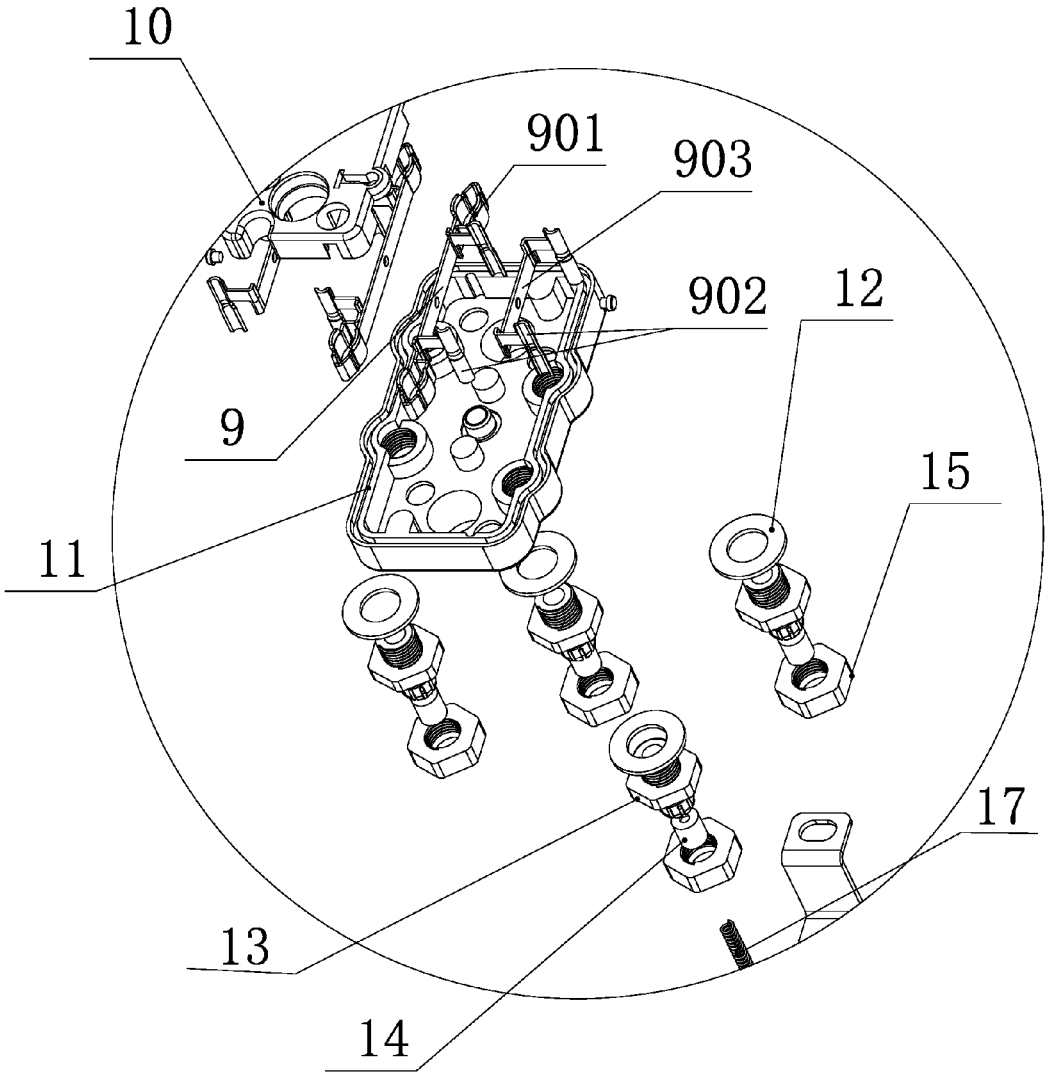
FIG. 8 is an exploded perspective view of electrical components of the waterproof socket according to the above preferred embodiment of the present invention.
Figure 9:
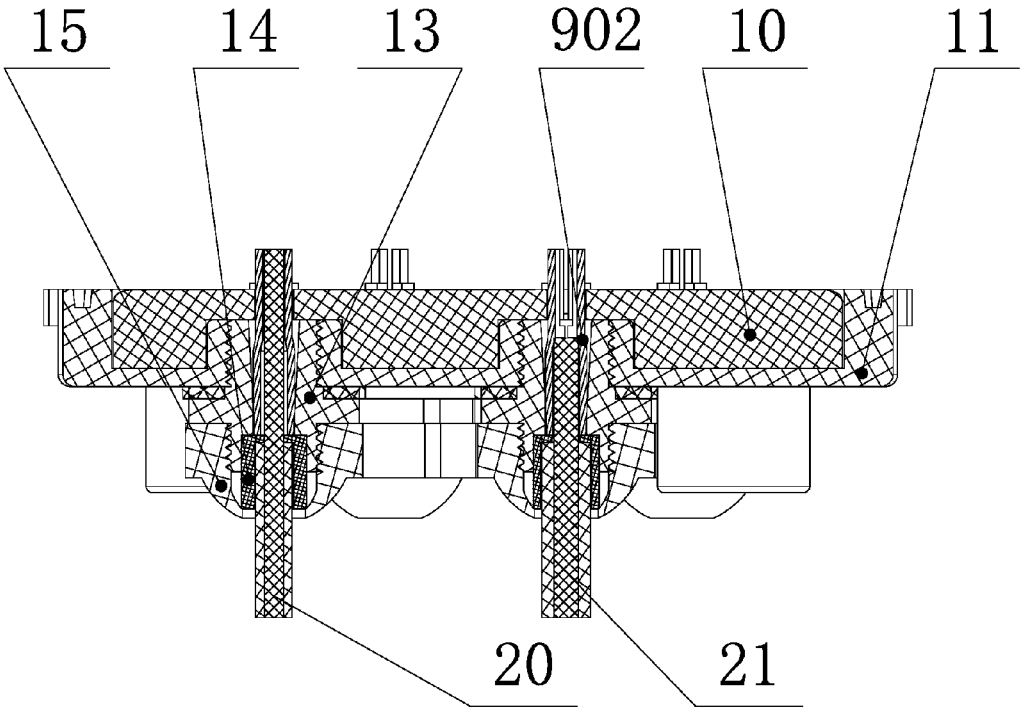
FIG. 9 is a sectional view of a wire assembly of the waterproof socket according to the above preferred embodiment of the present invention.

As shown in FIG. 8 and FIG. 9, each of the wiring terminals 902 of the conducting sheet 9 is divided into at least two sections in axial direction, and an inner diameter of a lower section is larger than an inner diameter of an upper section. Thus, various kinds of conductive lines of different thickness can be inserted through the wiring terminals 902, which has a broader range of usage. As shown in the FIG. 9, a conductive line 20 on left side is a thin conductive line, and can be inserted to the end, and a conductive line on right side is a thick conductive line, and cannot be inserted completely. However, the wiring terminals 902 would increase degree of difficulty of producing the conducting sheet 9 after being divided into sections. For this reason, a connecting sheet 903 is added at a side of the conducting sheet 9, and the connecting sheet 903 is fixed to the conducting sheet 9 through a screw. Each of the wiring terminals 902 can be disconnected along the axial direction to form in sections, wherein a first half of each of the wiring terminals 902 is connected with the conducting sheet 9, and the second half thereof is connected with the connecting sheet 903, wherein the wiring terminals 902 are combined together again after the connecting sheet 903 is fixed to the conducting sheet 9. For a case in which two wiring terminals 902 are provided on one conducting sheet 9, two disconnected parts can be set at two ends of the connecting sheet 903 respectively.

A waterproof sealing ring 14 is inserted in the wire assembly 13, and a screw cover 15 is rotatably mounted at a bottom of the wire assembly 13, wherein an inner cavity at a bottom portion of the screw cover 15 has a conical shape. Therefore, an upward rotation of the screw cover 15 will make the bottom of the wire assembly 13 and the waterproof sealing ring 14 to press at an electric wire tightly, so as to prevent water from entering into the bottom of the wire assembly 13. The wire assembly 13 is threaded with the socket base 11, and a sealing washer 12 is provided at a joint between the wire assembly 13 and the socket base 11 to ensure the joint of the wire assembly 13 and the socket base 11 to be water-tightened.

When the plug 19 is initially inserted, the plug 19 will push the upper seal doors 602 to move apart from the upper insertion holes 502 of the retention frame 5 and will drive the entire waterproof inner core 6 to move downwards. The waterproof inner core 6 is driven to rotate at the same time when it is moving downwards by cooperation of the sliding bar 601 of the waterproof inner core 6 and the arc protrusion 802 of the inner core fixing base 8. At the same time when the main body 606 of the waterproof inner core 6 is rotated downwards, the swing rods 603 are against the edge of the accommodating groove 801 of the inner core fixing base 8 to produce rotation and to make the lower seal doors 604 to move apart from the lower insertion holes 803 of the inner core fixing base 8. At the same time, the blockers 501 slide out of the sliding grooves 609 to release positional limitation of upper ends of the swing rods 603. At this time, the pins of the plug 19 are inserted and connected with the output terminals 901 in the conducting sheet 9. At this time, a sealing effect is achieved by cooperation of the sealing sheets 3 and the pins.

When the plug 19 is pulled out, the restoring force of the torsion spring 7 will push the waterproof inner core 6 to rotate and restore position. The sliding bar 601 is guided to the top of the arc protrusion 802 due to block of the arc protrusion 802, such that the waterproof inner core 6 will move upwardly. The upper seal doors 602 will then seal at the upper insertion holes 502 of the retention frame 5 again. When the main body 606 rotates and moves upwards to its restore position, the blockers 501 are embedded into the sliding grooves 609 again to press against the upper surfaces of the swing rods 603, wherein the lower seal doors 604 of the swing rods 603 are driven to rotate downwards and to seal at the lower insertion holes 803 of the inner core fixing base 8 again, which also achieves a sealing effect.

The waterproof socket of the present invention is able to be mounted on the wall, the floor or the extension cord structure. When the plug 19 is not inserted, the upper seal doors 602 are able to seal at the upper insertion holes 502 of the retention frame 5, and the lower seal doors 604 are able to seal at the lower insertion holes 803 of the inner core fixing base 8. This dual protection configuration prevents water or moisture from entering into the waterproof socket. When the plug 19 is connected with the socket, the plug 19 cooperates with two layers of upper and lower sealing sheets, which can prevent water from entering into the waterproof socket efficiently. An upward rotation of the screw cover 15 is able to make the lower end of the wire assembly 13 and the waterproof sealing ring 14 to press electric wire tightly so as to prevent water from entering into the bottom portion. Even if the socket is entirely submerged into water, there will prevent water entering into the socket, which is very safe.

Figure 10:
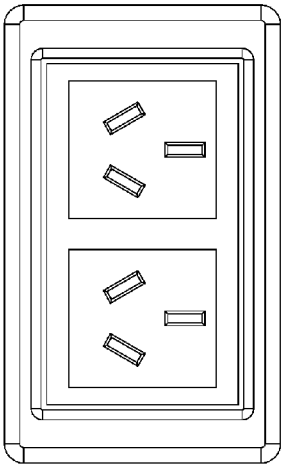
FIG. 10 is a schematic diagram illustrating a socket of Asia electrical socket system incorporated with the waterproof socket of the present invention.
Figure 11:
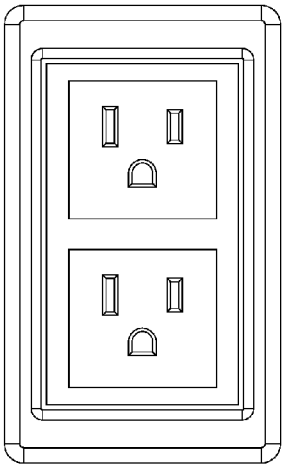
FIG. 11 is a schematic diagram illustrating a socket of American electrical socket system incorporated with the waterproof socket of the present invention.
Figure 12:
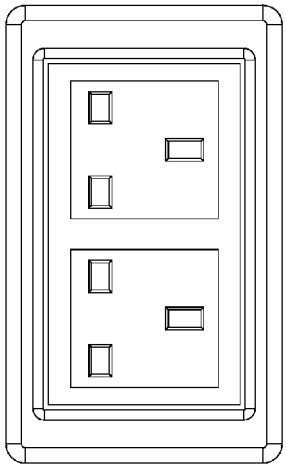
FIG. 12 is a schematic diagram illustrating a socket of English electrical socket system incorporated with the waterproof socket of the present invention.
Figure 13:
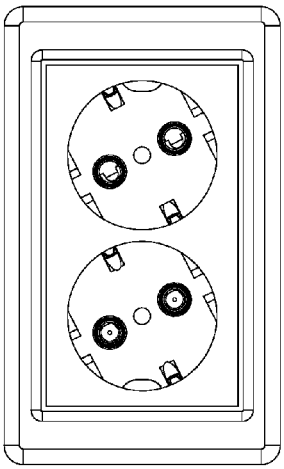
FIG. 13 is a schematic diagram illustrating a socket of Italian electrical socket system incorporated with the waterproof socket of the present invention.
Figure 14:
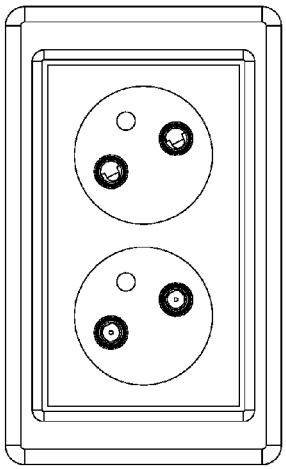
FIG. 14 is a schematic diagram illustrating a socket of French electrical socket system incorporated with the waterproof socket of the present invention.

As shown in FIGS. 10 to 14, the waterproof socket of the present invention can be manufactured into many models of Asia electrical socket system, American electrical socket system, English electrical socket system, Italian electrical socket system and French electrical socket system or the like. Here, FIG. 10 shows a socket of Asia electrical socket system. FIG. 11 shows a socket of American electrical socket system. FIG. 12 shows a socket of English electrical socket system. FIG. 13 shows a socket of Italian electrical socket system. FIG. 14 shows a socket of French electrical socket system. Differences of sockets of various kinds of models are only in differences of shapes of socket holes and different forms of a ground clamp 4, the ground clamp 4 is replaced with a ground jack. For a socket having three socket holes, the waterproof inner core 6 can be provided at center of rotation of the three socket holes, and three upper seal doors and three lower seal doors are provided correspondingly. Therefore, variations of the models of the socket are also in the range sought for protection by the present invention.

Figure 15:
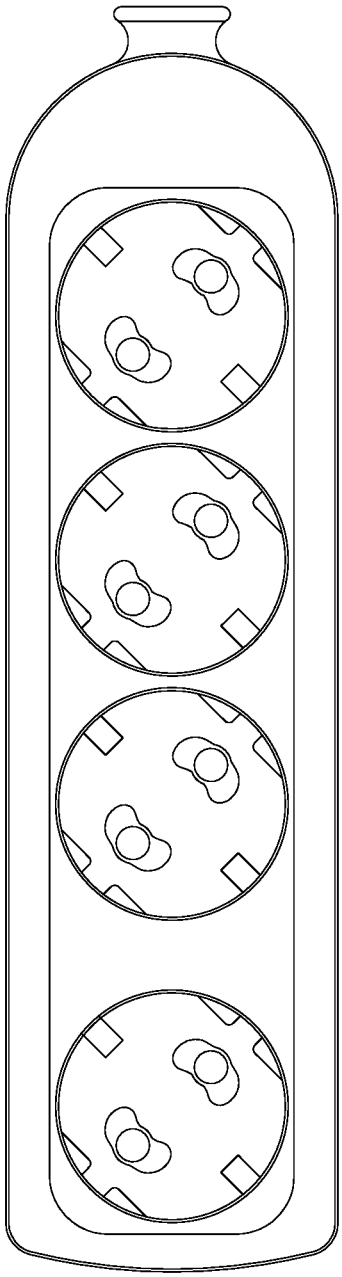
FIG. 15 is a schematic diagram illustrating an extension cord structure incorporated with the waterproof socket of the present invention.

As show in FIG. 15, the waterproof socket of the present invention can be manufactured as a movable wiring board, and an internal structure of the extension cord structure is same as that of the socket of the present invention, which also has a waterproof effect.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A waterproof socket for a plug having a plurality of pins, comprising:

a retention frame having a plurality of upper insertion holes;

a socket base;

a conducting sheet, which is provided in said socket base, having a plurality of output terminals coaxial with said upper insertion holes;

an inner core fixing base provided between said retention frame and said socket base, wherein said inner core fixing base has a plurality of lower insertion holes coaxial with said output terminals of said inner core fixing base for the pins of the plug inserting into said lower insertion holes through said upper insertion holes; and a waterproof inner core which is adapted to be moved between a first non-usage position that the waterproof socket is not used, and a second usage position that the plug inserts into the waterproof socket, wherein said waterproof inner core comprises:

two upper seal doors aligned with said upper insertion holes of said retention frame, wherein at first non-usage position, said upper insertion holes are sealed by said upper seal doors, wherein at said second usage position, said upper seal doors are pushed to move away from said upper insertion holes by the pins of the plug for enabling the pins of the plug to insert into said upper insertion holes.

2. The waterproof socket, as recited in claim 1, wherein said waterproof inner core further comprises a main body movably supported by said inner core fixing base, wherein said upper seal door are provided on two upper peripheral sides of said main body respectively.

3. The waterproof socket, as recited in claim 2, wherein said waterproof inner core further comprises:

two swing rods pivotally coupled at said main body; and two lower seal doors are provided at inner ends of said swing rods respectively, wherein at first non-usage position, said lower insertion holes are sealed by said lower seal doors, wherein said upper seal doors and said lower seal doors provides a dual waterproof protection structure, wherein at second usage position, said lower seal doors are pushed to move away from said lower insertion by the pins of the plug for enabling the pins of the plug to insert into said lower insertion holes through said upper insertion holes.

4. The waterproof socket, as recited in claim 2, wherein said waterproof inner core further comprises a rotation and guide apparatus provided between said inner core fixing base and said waterproof inner core, wherein said rotation and guide apparatus comprises an arc protrusion formed in said inner core fixing base, and a sliding bar provided on a sidewall of said main body of said waterproof inner core, wherein said sliding bar is guided by an upper surface of said arc protrusion.

5. The waterproof socket, as recited in claim 2, wherein said waterproof inner core further comprises a torsion spring provided between a bottom portion of said main body and said inner core fixing base for driving said main body to rotate and to restore to its position.

6. The waterproof socket, as recited in claim 2, wherein said inner core fixing base has an accommodating groove provided between two lower insertion holes, wherein said main body is movably inserted in said accommodating groove.

7. The waterproof socket, as recited in claim 3, wherein said waterproof inner core further comprises a restoring and down-pressing device provided between said retention frame and said swing rods, wherein said restoring and down-pressing device comprises two blockers formed at a bottom of said retention frame, wherein a center of an upper end of said main body has a through hole, wherein said blockers are against upper surfaces of corresponding said swing rods after passing through said through hole, wherein a plurality of sliding grooves are formed on the upper surfaces of said swing rods, and said blockers move out of the sliding grooves when said main body of said waterproof inner core moves downwards and rotates, and said blockers are embedded into said sliding grooves when said main body of said waterproof inner core moves to its restore position.

8. The waterproof socket, as recited in claim 3, further comprising a spring, having a W-shape, provided between said two swing rods, wherein two ends of said spring are inserted into said sidewalls of corresponding said swing rods respectively.

9. The waterproof socket, as recited in claim 8, further comprising a closing plate, wherein said spring in W-shape is connected to said main body through said closing plate.

10. The waterproof socket, as recited in claim 1, further comprising a plurality of sealing sheets embedded between an upper surface of said retention frame and an lower surface of said inner core fixing base, wherein each of said sealing sheets has one or more sealing holes coaxial with said upper insertion hole and said lower insertion hole, wherein a diameter of each of said sealing holes is smaller than a diameter of each of said upper insertion holes and a diameter of each of said lower insertion holes.

11. The waterproof socket, as recited in claim 1, further comprising a wire assembly provided at a bottom of said socket base and sleeved with a plurality of wiring terminals of said conducting sheet, wherein each of said wiring terminals of said conducting sheet is divided into at least two sections in axial direction, wherein an inner diameter of a lower section is larger than an inner diameter of an upper section, wherein said wire assembly is threaded with said socket base, and a sealing washer is provided at a joint between said wire assembly and said socket base.

12. A waterproof inner core for a socket which comprises a retention frame having a plurality of upper insertion holes and an inner core fixing base having a plurality of lower insertion holes coaxial with the upper insertion holes for enabling for pins of a plug to insert into the lower insertion holes through the upper insertion holes, wherein said waterproof inner core comprises:

a main body adapted for being movably supported by the inner core fixing base, wherein said main body is actuated, in response to the pins of the plug, between a first non-usage position that the socket is not used, and a second usage position that the plug inserts into the socket;

two upper seal doors spacedly extended from said main body for aligning with the upper insertion holes of said retention frame, wherein at said first non-usage position, said upper seal doors are driven for sealing at the upper insertion holes, wherein at said second usage position, said upper seal doors are pushed for moving away from the upper insertion holes by the pins of the plug for enabling the pins of the plug to insert into the lower insertion holes through the upper insertion holes.

13. The waterproof inner core, as recited in claim 12, further comprising:

two swing rods pivotally coupled at said main body; and two lower seal doors provided at inner ends of said swing rods respectively, wherein at said first non-usage position, said lower seal doors are driven for sealing at the lower insertion holes, wherein said upper seal doors and said lower seal doors provides a dual waterproof protection structure, wherein said lower seal doors are pushed for moving away from the lower seal holes by the pins of the plug for enabling the pins of the plug to insert into the lower insertion holes through the upper insertion holes.

14. The waterproof inner core, as recited in claim 13, wherein an inner end of each of said swing rods is hinged to said main body, and an outer end of each of said swing rods is extended toward the lower insertion hole of the inner core fixing base, wherein said upper seal door are provided on two upper peripheral sides of said main body respectively.

15. The waterproof inner core, as recited in claim 14, further comprising a rotation and guide apparatus provided between said inner core fixing base and said waterproof inner core, wherein said rotation and guide apparatus comprises an arc protrusion for being formed in said inner core fixing base, and a sliding bar provided on a sidewall of said main body, wherein said sliding bar is guided by an upper surface of said arc protrusion.

16. The waterproof inner core, as recited in claim 12, further comprising a torsion spring provided between a bottom portion of said main body and said inner core fixing base for driving said main body to rotate and to restore to its position.

17. The waterproof inner core, as recited in claim 12, wherein said main body is movably inserted in said accommodating groove which is provided between two lower insertion holes.

18. The waterproof inner core, as recited in claim 14, further comprising a restoring and down-pressing device provided at said swing rods, wherein said restoring and down-pressing device comprises two blockers, wherein a center of an upper end of said main body has a through hole, wherein said blockers are against upper surfaces of corresponding said swing rods after passing through said through hole, wherein a plurality of sliding grooves are formed on the upper surfaces of said swing rods, and said blockers move out of the sliding grooves when said main body moves downwards and rotates, and said blockers are embedded into said sliding grooves when said main body moves to its restore position.

19. The waterproof inner core, as recited in claim 14, further comprising a spring, having a W-shape, provided between said two swing rods, wherein two ends of said spring are inserted into said sidewalls of corresponding said swing rods respectively.

20. The waterproof inner core, as recited in claim 18, further comprising a closing plate, wherein said spring in W-shape is connected to said main body through said closing plate.

* * * * *